US007554063B2

(12) United States Patent
Hess et al.

(10) Patent No.: US 7,554,063 B2
(45) Date of Patent: Jun. 30, 2009

(54) HEATING APPARATUS

(75) Inventors: Kristoffer Hess, Cambridge (CA); Jeffery J. Kube, Brantford (CA)

(73) Assignee: Dimplex North America Limited, Cambridge, ON (CA)

( * ) Notice: Subject to any disclaimer, the term of this patent is extended or adjusted under 35 U.S.C. 154(b) by 346 days.

(21) Appl. No.: 11/466,308

(22) Filed: Aug. 22, 2006

(65) Prior Publication Data

US 2008/0083745 A1 Apr. 10, 2008

(51) Int. Cl.
*H05B 3/44* (2006.01)
*H05B 3/78* (2006.01)

(52) U.S. Cl. ..... 219/528; 219/509; 219/529; 219/552; 219/553; 219/392; 392/457; 392/365; 392/360; 392/364; 392/368; 338/297; 338/241; 338/274

(58) Field of Classification Search ..... 219/528–9, 219/552–3, 540, 544, 509; 392/457, 365, 392/360, 364, 368; 338/297, 241, 274; 165/121
See application file for complete search history.

(56) References Cited

U.S. PATENT DOCUMENTS 1,531,515 A 3/1925 Simmons
1,555,666 A 9/1925 Hartwig
2,022,559 A 11/1935 Dwyer
2,158,605 A * 5/1939 Wiegand ..... 392/365
2,780,715 A 2/1957 Strokes
2,783,353 A 2/1957 Finn
3,154,669 A 10/1964 Binder
3,176,117 A * 3/1965 Knoll et al. ..... 392/360
3,912,907 A 10/1975 Lodi
3,931,495 A 1/1976 Dzaack et al.
3,934,116 A 1/1976 Cunningham et al.
3,943,328 A 3/1976 Cunningham
4,001,547 A 1/1977 Boggs et al.
4,010,350 A 3/1977 Cunningham
4,044,224 A 8/1977 Jenkins et al.
4,358,669 A 11/1982 Bryson, Jr.
4,484,243 A 11/1984 Herbst et al.
4,543,469 A 9/1985 Cunningham
5,414,794 A 5/1995 Shao
5,526,462 A 6/1996 Kondo et al.

* cited by examiner

*Primary Examiner*—Shawntina Fuqua

(57) ABSTRACT

A heating apparatus including a housing defining a volume of air therein having an inlet and an outlet aperture. The heating apparatus also includes a heat generator having an elongate tubular metal sheath extending between an inner end and an outer end, a resistive wire within the sheath, and a substantially nonconducting material for electrically isolating the sheath relative to the resistive wire. The heat generator includes a terminal portion at the inner end and a heating portion extending between the terminal portion and the outer end of the sheath. The terminal portion is adapted for connection to a source of electrical power. Also, the heating portion of the heat generator is positioned in the housing to heat the volume of air. The heating apparatus also includes one or more insulators for electrically isolating the sheath relative to the housing.

8 Claims, 13 Drawing Sheets

HEATING APPARATUS

FIELD OF THE INVENTION

This invention is related to a heating apparatus including a sheathed element.

BACKGROUND OF THE INVENTION

Portable electric heaters including sheathed elements are known. Typically, such heaters include a fan in a housing which blows air through a coiled sheathed element, which heats the air before the air exits the housing. The housing is usually elongate, with openings at its opposing ends to permit ingress and egress of air.

As is well known in the art, the sheathed element 10 includes a resistive wire 12 positioned inside a sheath 14. Typically, the sheath is usually made of a suitable metal material which is a relatively good conductor of heat, e.g., steel. Also, the wire is electrically insulated from the sheath by an insulator 16. The insulator 16 is any suitable insulating material, e.g., magnesium oxide (MgO).

In the prior art, and as schematically shown in FIG. 1A, the sheathed element is grounded. In general, where the element is readily accessible (i.e., where the element could easily be touched by a user, through inadvertence), the element is required to be grounded. Because the sheath is grounded, at any time when current can flow from the resistive wire to the sheath, there is a voltage across the circuit formed by the resistive wire and the sheath (FIG. 1B). Although many prior art sheathed elements generally perform satisfactorily, arcing or failure of the prior art sheathed element is relatively common, and can have serious consequences. Failure of the sheathed element is generally understood to occur due to three different causes, as follows.

First, failure can occur when the resistive wire touches the sheath. (This situation is schematically illustrated in FIG. 1B.) If this were to happen in manufacturing the product would not pass the hi-pot test on the production line and would be rejected. However, if over time the resistive wire (having been properly positioned when the sheathed element was manufactured) were to creep towards the sheath and ultimately contact it, then an arc would occur. It is thought that this occurs due to materials expanding in use, or due to curved or bent elements.

Second, failure can occur due to too much moisture in the insulation inside the sheath. Moisture is conductive, and when heaters sit in humid conditions moisture can be absorbed into the insulation. Too much moisture can also get into the insulation when a sheath is cracked and in contact with moisture. When this happens, current can pass from the resistive wire to the sheath, potentially causing a failure (i.e., if the current leakage is sufficient).

Failure can also occur due to oxidation of the resistive wire. In this case, the resistive wire oxidizes over time, and a scaling build-up occurs. The scales break away from time to time, causing the wire diameter to become smaller, ultimately resulting in mechanical failure of the resistive wire. With each mechanical failure of the resistive wire, the diameter of the resistive wire decreases. Finally, the wire becomes sufficiently small that a hot spot occurs and the sheathed element fails altogether.

As described in U.S. Pat. No. 4,484,243 (Herbst et al.), arcing between an end of the resistive wire and the sheath can result in "zippering" taking place along the sheath (col. 1, at lines 40-64).

Herbst et al. discloses one prior art solution to the problem. In Herbst et al., a protective circuit arrangement to protect sheathed heating elements is disclosed. The protective circuit interrupts ground fault conditions by decoupling the power line from the heating element. Fusible links are used in the protective circuit. However, the protective circuit disclosed in Herbst et al. is not activated until a failure (i.e., a ground fault) has occurred, which means that the sheathed element must first have been damaged, at least to an extent, before the protective circuit decouples the heating element from the power source.

There is therefore a need for an improved heater apparatus which overcomes or mitigates one or more of the disadvantages of the prior art.

SUMMARY OF THE INVENTION

In its broad aspect, the invention provides a heating apparatus including a housing defining a volume of air therein and having an inlet aperture and an outlet aperture. The apparatus also includes a heat generator having an elongate tubular metal sheath extending between an inner end and an outer end, a resistive wire within the sheath, and a substantially nonconducting material for electrically isolating the sheath relative to the resistive wire. The heat generator has a terminal portion at the inner end and a heating portion extending between the terminal portion and the outer end of the sheath, and the terminal portion is adapted for connection to a source of electrical power. The heating portion of the heat generator is positioned in the housing to heat the volume of air. The apparatus also includes one or more insulators for electrically isolating the sheath relative to the housing.

In another aspect, the insulator includes a body with at least one aperture therein wherein at least a part of the terminal portion is receivable.

In another aspect, the invention provides one or more support elements for locating the heat generator in a predetermined position relative to the inlet and outlet apertures. Also, the apparatus includes one or more support insulator elements for electrically isolating the support element relative to the housing.

In yet another aspect, the apparatus includes one or more fasteners for securing the support element to the housing, and the support insulator element includes a body with one or more apertures therein wherein the fastener is receivable.

In another aspect, the invention provides an insulator for electrically isolating a sheath in a sheathed element positioned in a housing of a heating apparatus relative to the housing. The insulator includes a body portion which has one or more apertures for receiving a preselected segment of the sheath.

In yet another aspect, the invention provides a support insulator element for electrically isolating a support element adapted for locating at least a portion of a heat generator in a predetermined position in a housing, the support element being attached to said housing by at least one fastener. The support insulator element includes a body portion with one or more apertures in which the fastener is receivable.

In another of its aspects, the invention provides a support insulator element for electrically isolating a sheath in a sheathed element located in a predetermined position in a housing by one or more support elements. The support insulator element includes a body portion adapted to be positioned between the sheath and the support element for electrically isolating the sheath relative to the housing.

BRIEF DESCRIPTION OF THE DRAWINGS

The invention will be better understood with reference to the attached drawings, in which.

DETAILED DESCRIPTION

Figure 2:
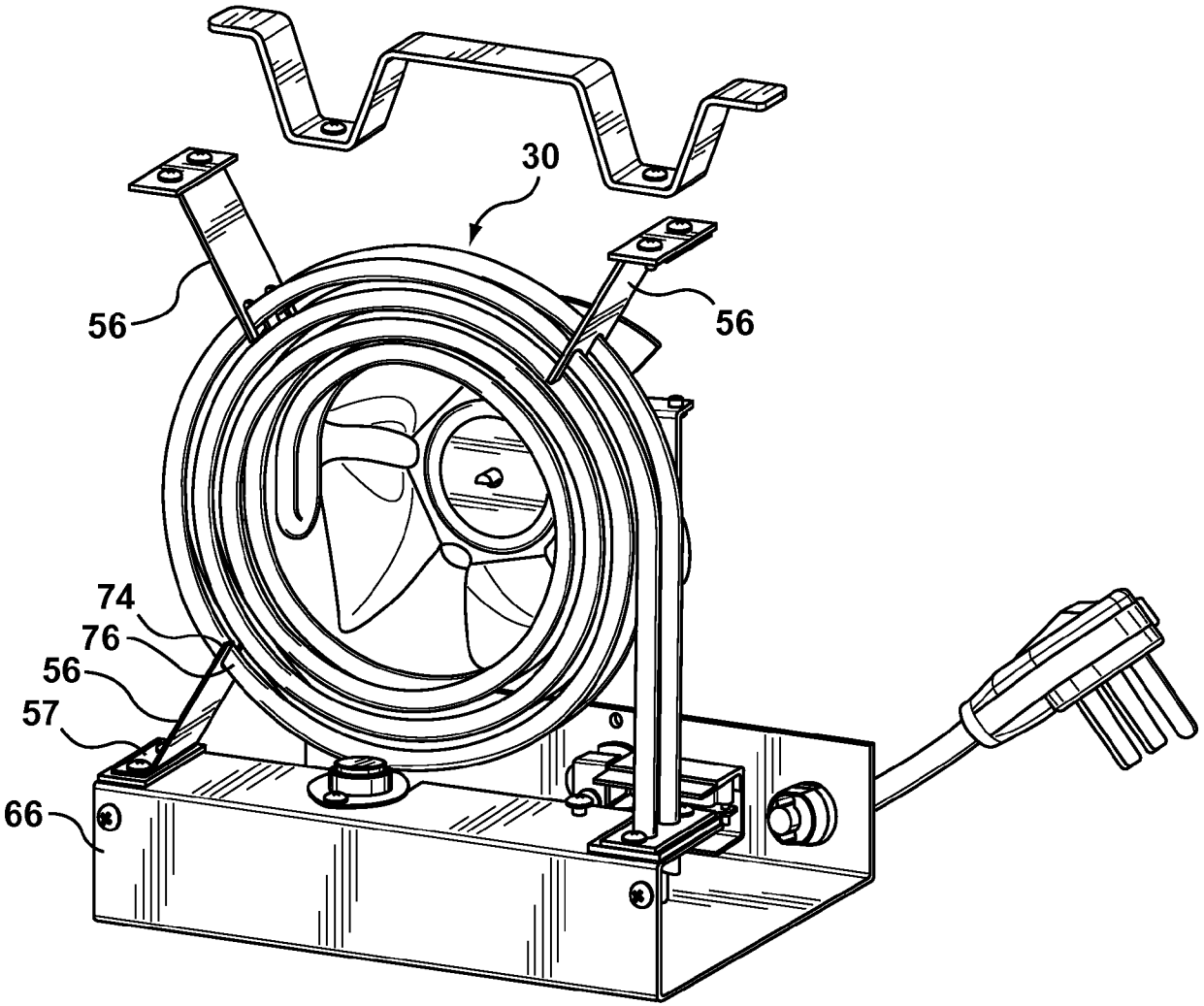
FIG. 2 is an isometric view of a heat generator in an embodiment of a heating apparatus of the invention positioned on a base portion of a housing.
Figure 3:
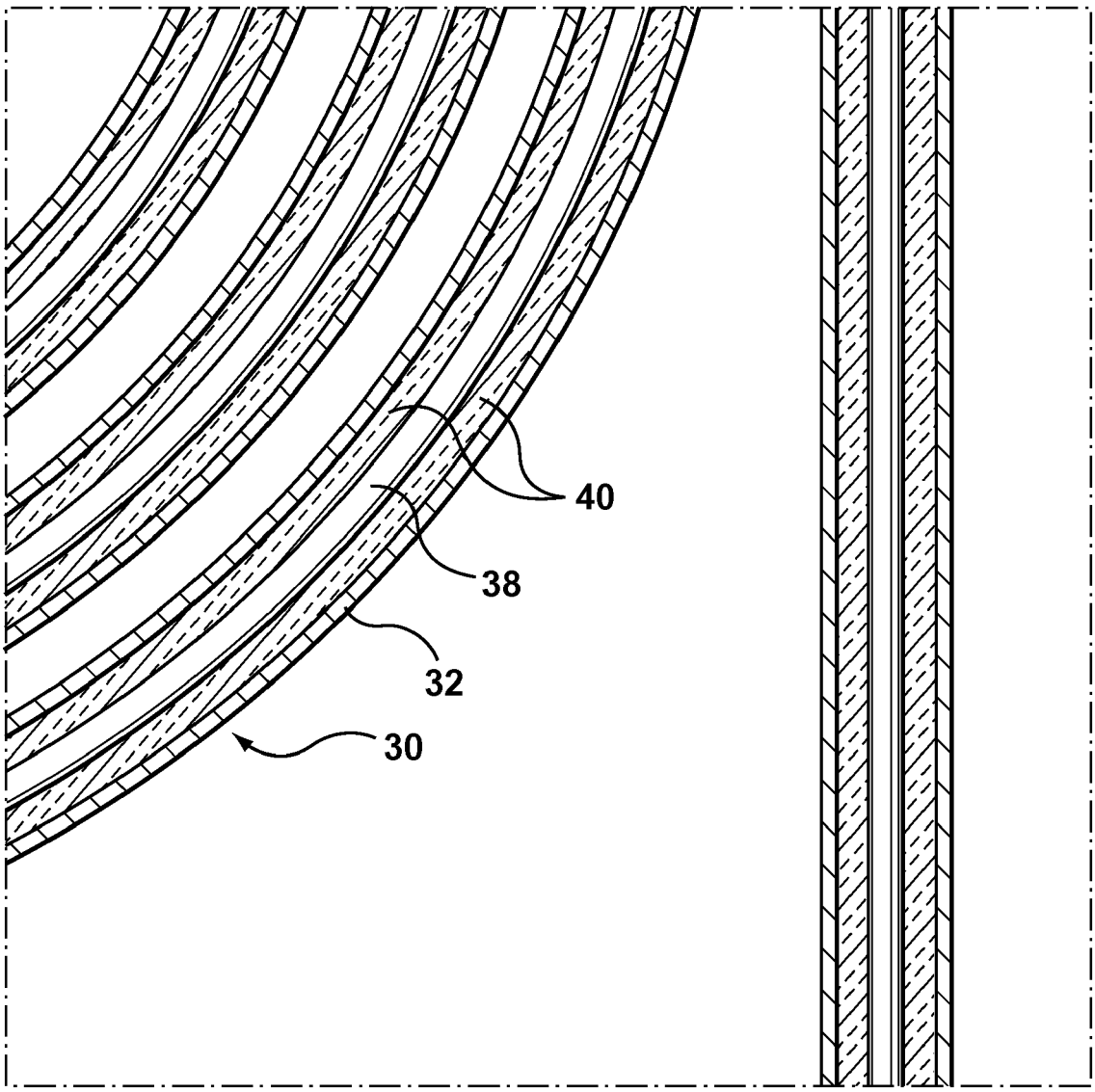
FIG. 3 is a cross-section of a portion of a sheathed element.
Figure 4:
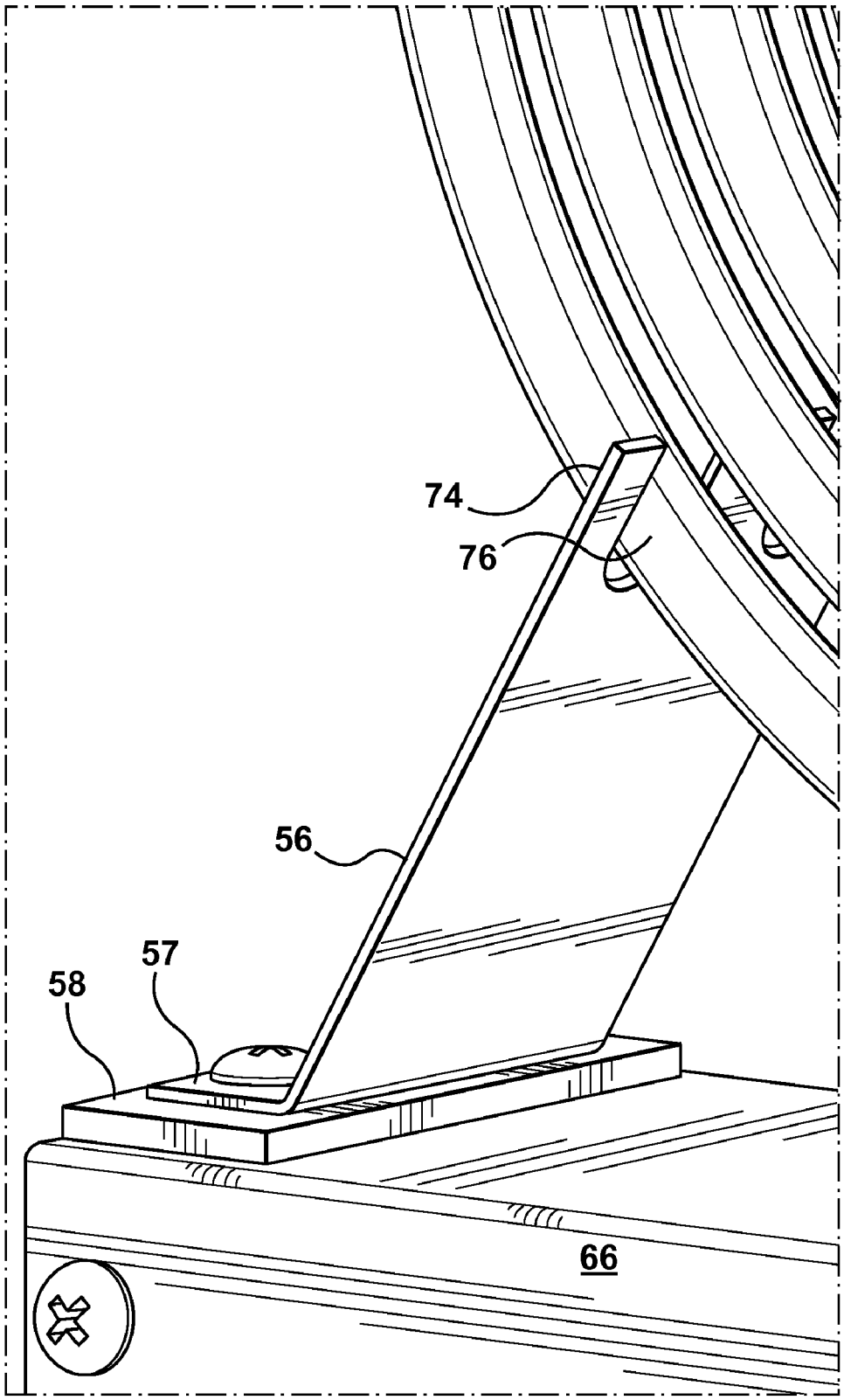
FIG. 4 is an isometric view of a support element of the heating apparatus of FIG. 2 with an embodiment of a support insulator element of the invention positioned between the support element and the housing, drawn at a larger scale.
Figure 5:
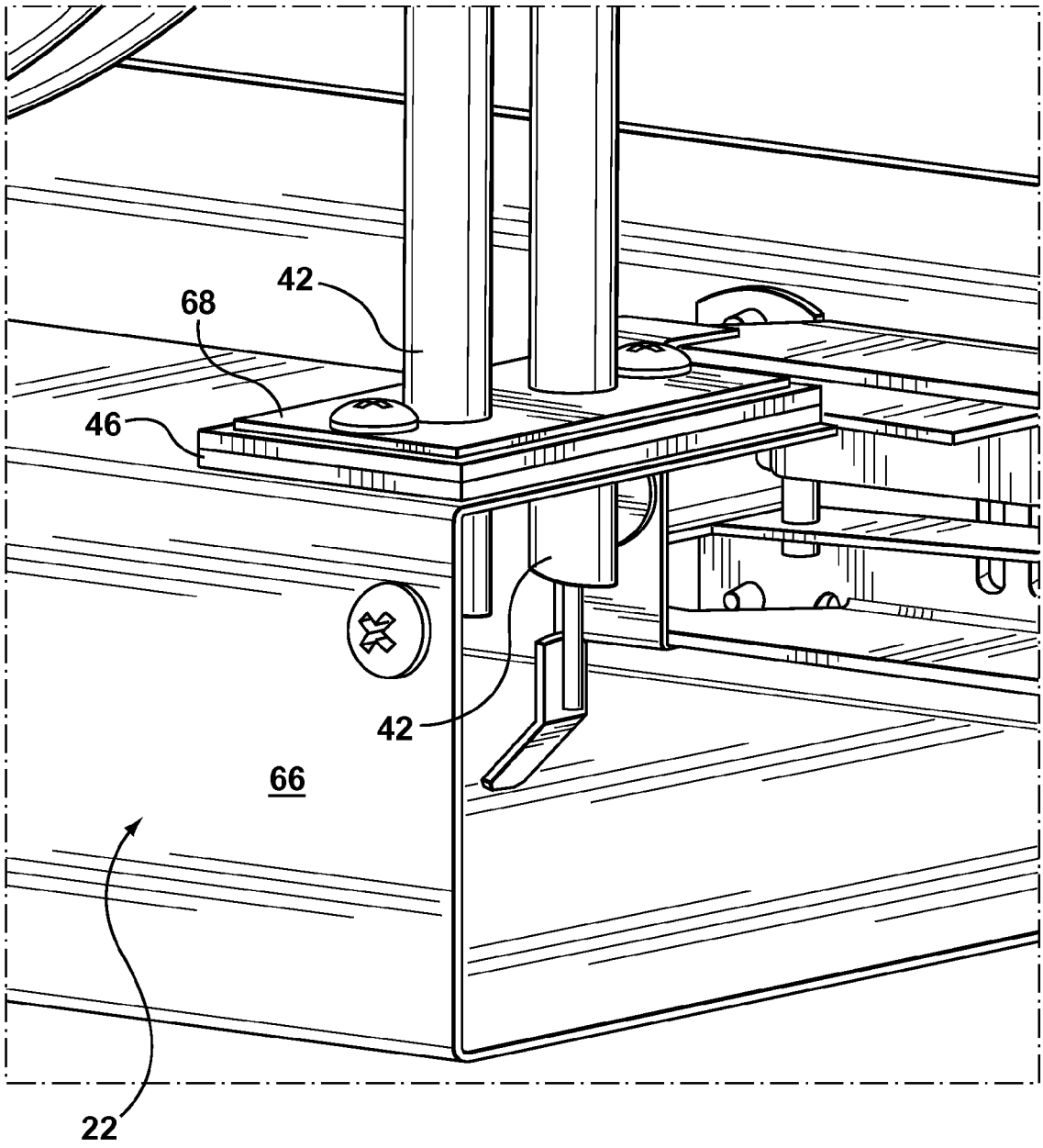
FIG. 5 is an isometric view of an embodiment of an insulator element of the invention in which a part of a terminal portion of the heat generator of FIG. 2 is received.
Figure 6:
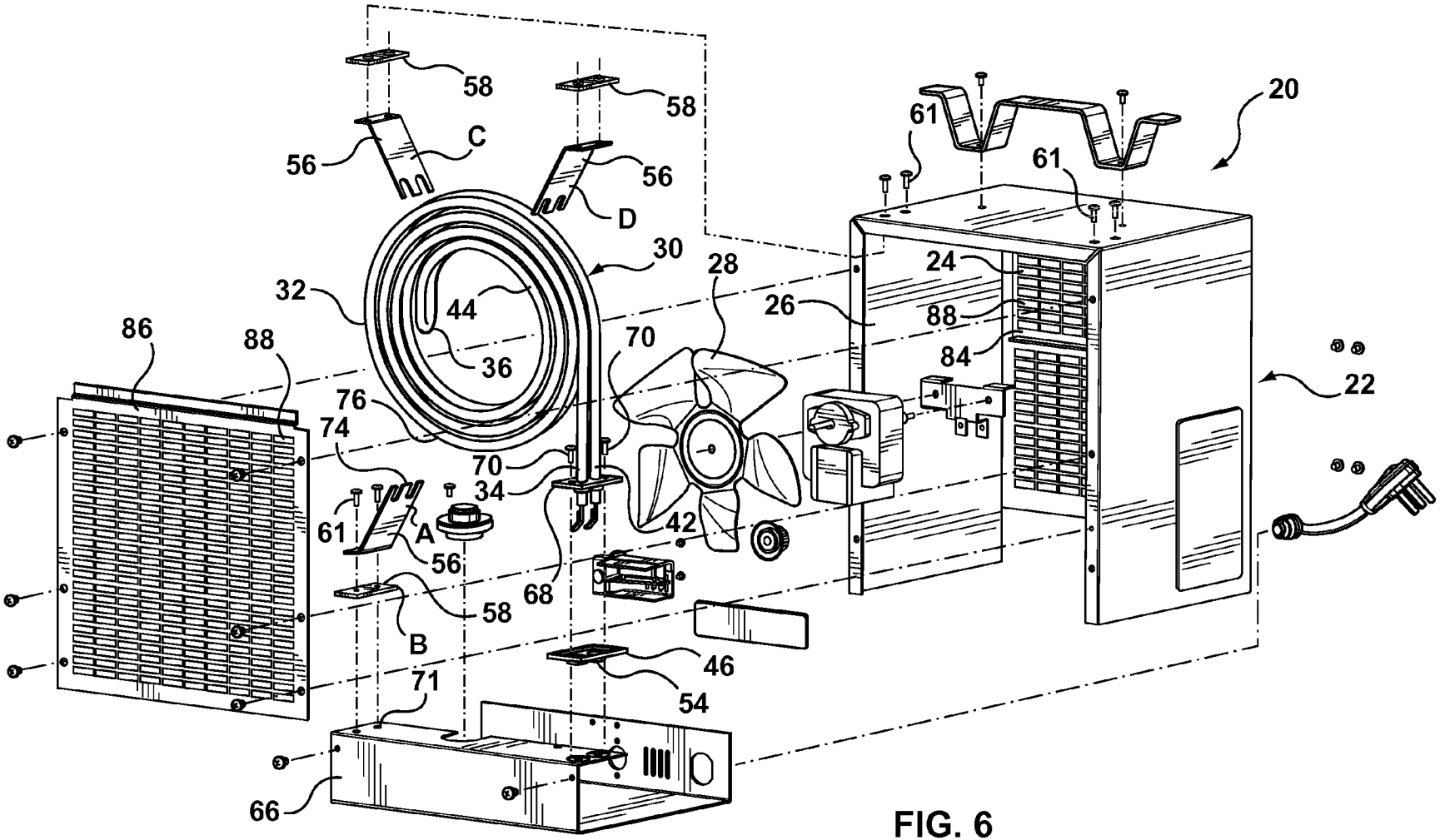
FIG. 6 is an exploded isometric view of an embodiment of the heating apparatus of the invention, drawn at a smaller scale.

Reference is first made to FIGS. 2-7 to describe an embodiment of a heating apparatus in accordance with the invention indicated generally by the numeral 20. As can be seen in FIG. 6, the heating apparatus 20 includes a housing 22 having an inlet aperture 24 and an outlet aperture 26. The housing 22 defines a volume of air (not shown) therein. Preferably, the heating apparatus 20 additionally includes a heat generator 30. The heat generator 30 includes an elongate tubular metal sheath 32 extending between an inner end 34 and an outer end 36 (FIG. 6). The heat generator 30 also includes a resistive wire 38 positioned within the sheath 32 and a substantially non-conducting material 40 for electrically isolating the sheath 32 relative to the resistive wire 38 (FIG. 3).

It is preferred that the heat generator 30 has a terminal portion 42 disposed at the inner end 34 and a heating portion 44 extending between the terminal portion 42 and the outer end 36 of the sheath 32. The terminal portion 42 is adapted for connection to a source of electrical power (not shown), and the heating portion 44 is positioned in the housing 22 to heat the volume of air. It is also preferred that the apparatus 20 includes one or more insulators 46 for electrically isolating the sheath 32 relative to the housing 22, as will be described.

Figure 10:
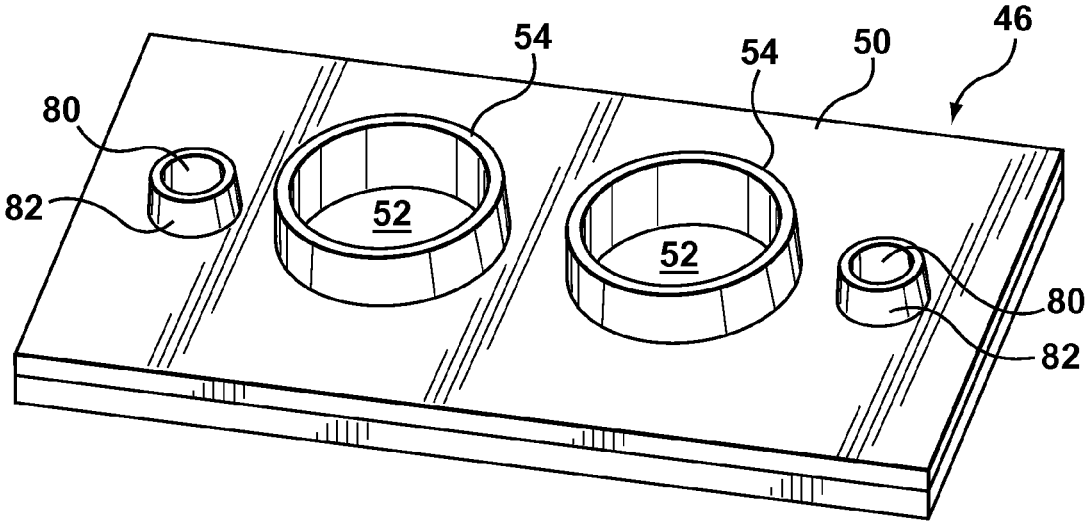
FIG. 10 is an isometric view of an embodiment of the insulator element of the invention.

The insulator 46 preferably includes a body 50 with one or more apertures 52 therein (FIG. 10). At least a part of the terminal portion 42 of the heat generator 30 is receivable in the apertures 52. It is also preferred that the body 50 includes one or more sleeves 54, each sleeve 54 being coaxial with an aperture 52. The sleeve 54 is for electrically isolating the terminal portion 42 from the housing 22. Preferably, a part of the terminal portion 42 is receivable in the aperture 52 and the sleeve 54 in a close-sliding fit, as will be described.

In one embodiment, the heating apparatus 20 preferably includes one or more support elements 56 for locating the heat generator 30 in a predetermined position relative to the inlet and outlet apertures 24, 26 (FIGS. 2, 6). Each support element 56 includes a plate portion 57, as will be described. The heating apparatus 20 preferably also includes one or more support insulator elements 58 for electrically isolating the support elements 56 relative to the housing 22, as will be described. It is preferred that each support insulator element 58 is positioned between each support element 56 and the housing 22 respectively.

Figure 9:
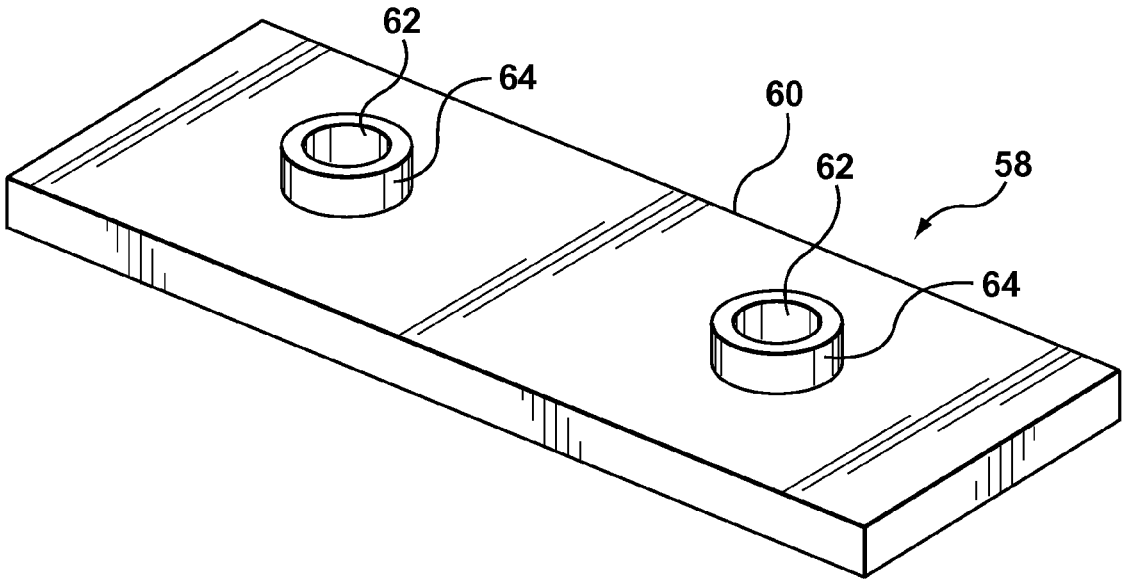
FIG. 9 is an isometric view of an embodiment of the support insulator element of the invention, drawn at a larger scale.

Preferably, the support insulator element 58 includes a body 60 (FIG. 9). Also, the apparatus 20 preferably includes one or more fasteners 61 (FIG. 6) for securing the support element 56 to the housing 22. It is also preferred that the body 60 includes one or more holes 62 in which the fasteners 61 are receivable. In one embodiment, the body 60 includes one or more sleeve elements 64, each such element being coaxial with a hole 62. The sleeve elements 64 are for electrically isolating the fastener from the housing. Preferably, each fastener 61 is receivable in the sleeve element 64 and the hole 62 in an interference fit.

The insulators 46, 58 preferably are made of any suitable material. Such material would generally be non-conductive to electricity (i.e., have a high resistance to leakage of current). Depending on the locations of the insulator elements vis-à-vis the heat generator, the insulator elements may not necessarily also be heat-resistant. However, insulation material which is heat-resistant is preferable. Preferably, the insulators 46, 58 are made of a high temperature resistant plastic. In particular, a plastic which is approximately 30 percent glass reinforced polybutylene teraphthalate has been found to be suitable. Various other suitable insulation materials will occur to those skilled in the art.

It is preferred that the fasteners 61 are metal screws. The sleeve elements 64 prevent contact between the housing and the screw in each case, so that the sheath is electrically isolated from the housing. Alternatively, screws which are made of an electrically insulating material may be used.

Figure 6A:
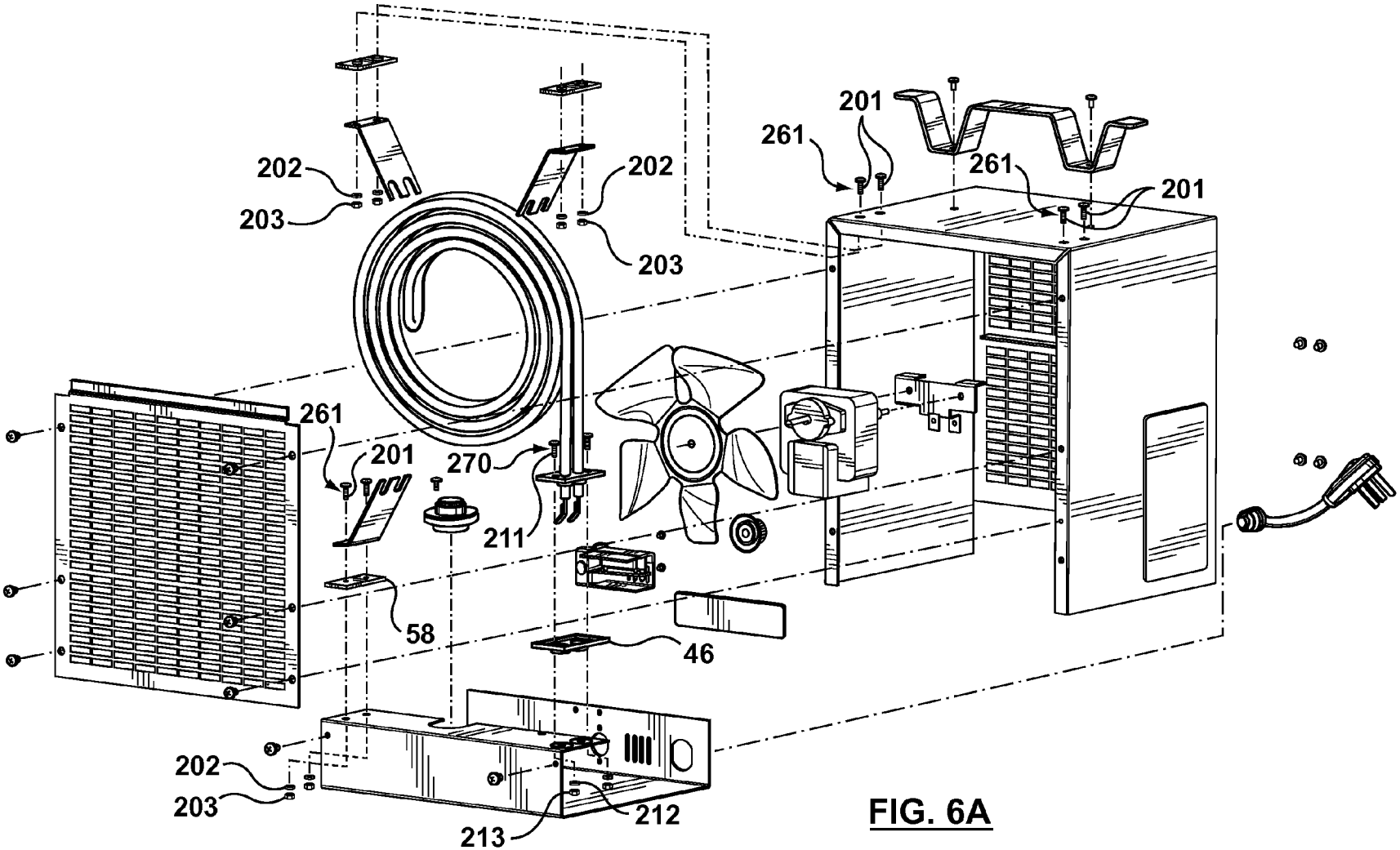
FIG. 6A is an exploded isometric view of another embodiment of the heating apparatus of the invention.
Figure 7:
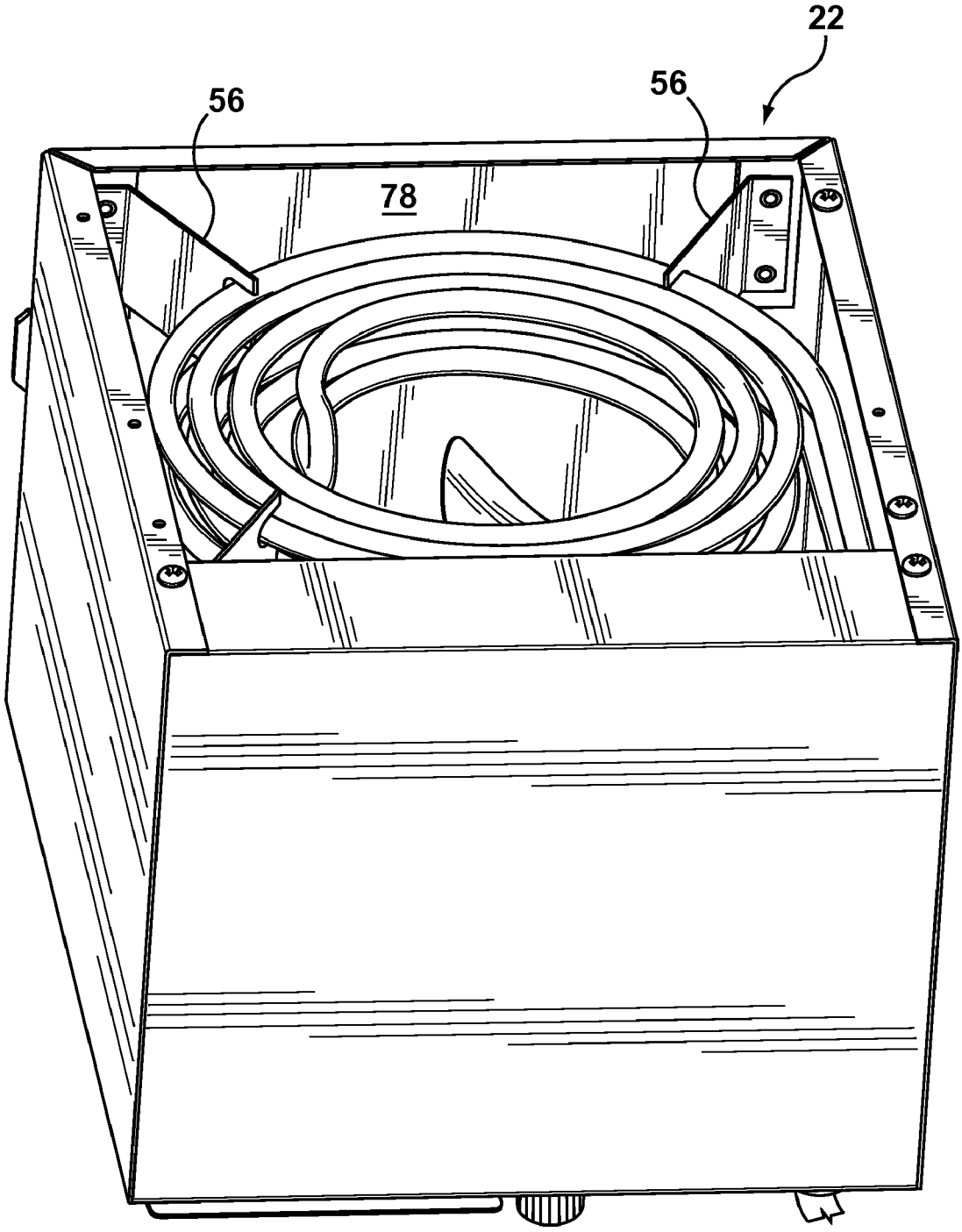
FIG. 7 is an isometric view of the heating apparatus of the invention in a partially assembled condition, drawn at a larger scale.
Figure 8:
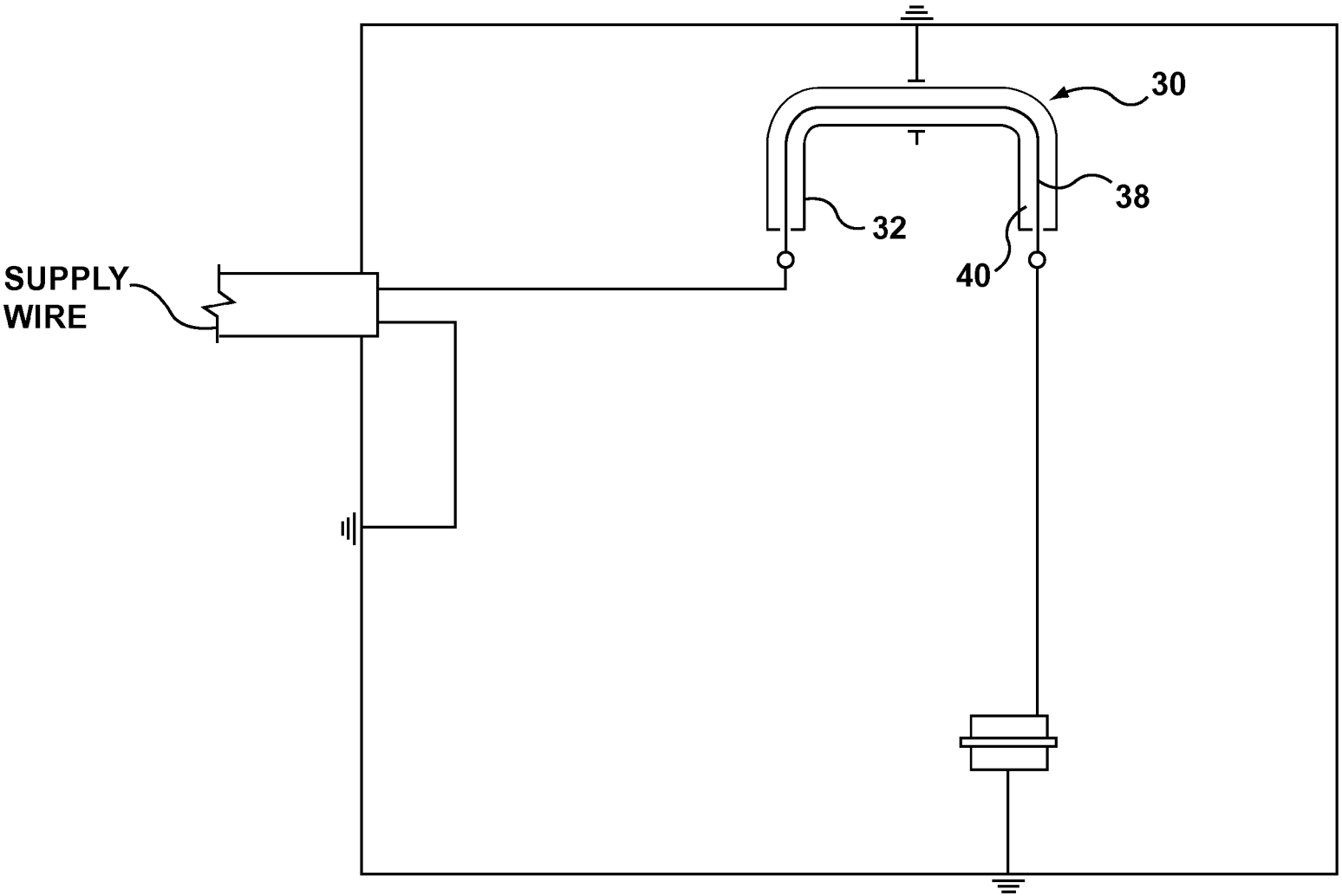
FIG. 8 is a circuit diagram for an embodiment of the heat generator of the invention.

In another alternative embodiment (FIG. 6A), the fastener 261 includes a bolt 201, a washer 202, and a nut 203. Preferably, the washer 202 is made of an insulation material, for electrical isolation of the sheath from the housing. The washer 202 preferably is made of any suitable insulation material, e.g. any suitable plastic. However, those skilled in the art will appreciate that the bolt 201 and/or the nut 203 may also (or alternatively) be made of an insulation material, e.g., any suitable plastic.

Preferably, the heating apparatus 20 also includes a fan 28 for moving the volume of air out of the housing 22 via the outlet aperture 26, and drawing air into the housing 22 via the inlet aperture 24. However, it will be understood that a fan is not required. For instance, a convection heater may include the insulators 46, 58 of the invention herein, i.e., insulators which electrically isolate the sheath relative to the housing. Such arrangement can be used in any heating application where the sheathed element is sufficiently physically shielded (e.g., by a screen) that an operator (not shown) is generally unable to contact inadvertently the sheathed element through such shielding.

It will also be understood that the heating apparatus 20 may include other components (e.g., a thermostat, and/or a fan speed control) which are well known in the art, and therefore do not need to be described herein.

In use, the insulator 46 and the support insulator element 58 are positioned adjacent to pre-drilled holes on a base portion 66 of the housing 22 (FIG. 2). Preferably, a plate 68 is positioned on the terminal portion 42 of the heat generator 30, the plate 68 having holes in which the terminal portion 42 is received. The insulator 46 is positioned on the base portion 66 so that the apertures 52 register with holes 69 in the base portion 66. Preferably, the insulator 46 is positioned with the sleeves 54 directed downwardly (FIG. 6). As indicated in FIG. 6, to assemble the apparatus 20, the heat generator 30 is moved relative to the base 66 so that a lower part of the terminal portion 42 passes through the apertures 52 and through the holes 69 until the plate 68 is sitting on the insulator 46. Fasteners 70 are then inserted, to attach the plate 68 and the insulator 46 securely to the base portion 66.

Preferably, the insulator 46 is positioned between the sheath 32 and the housing 22. The insulator 46 separates the sheath 32 and the housing 22 so that the sheath 32 and the housing 22 are electrically isolated from each other. More specifically, the insulator 46 electrically isolates the terminal portion 42 relative to the housing 22. As can be seen in FIG. 6, the insulator 46 preferably is positioned between the terminal portion 42 and the housing 22.

In addition, the support element 56 (identified as "A" in FIG. 6) is positioned on the support insulator element 58 (identified as "B") which is located on the base portion 66. The support insulator element 58 (B) is positioned on the base 66 so that its apertures 62 register with predrilled holes 71 in the base 66. Preferably, the support insulator element 58 used with element A is positioned with the sleeve elements 64 directed downwardly. The plate portion 57 of the support element 56 (identified as A) is positioned on the support insulator element 58, and holes in the plate portion 57 are aligned with the apertures 62. Fasteners 61 are then inserted through the holes in the plate portion 57, the apertures 62, and corresponding sleeve elements 64 to fasten the support element 58 securely to the base portion 66. A distal end 74 of the support element 56 preferably is configured to receive a portion 76 of the heat generator 30, so that the support element 56 supports the portion 76 (FIG. 2). In the same way, additional support elements 56 (identified as "C" and "D" respectively in FIG. 6) are attached to an upper portion 78 of the housing 22 (FIG. 7), with support insulator elements 58 located between the support elements 56 and the upper portion 78 in each case respectively.

Preferably, the body 50 includes additional holes 80 and fastener sleeve elements 82, each fastener sleeve element 82 being coaxial with a hole 80. The fasteners 70 are receivable in the fastener sleeve elements 82 and the holes 80, which electrically isolate the fasteners 70 from the housing 22. Preferably, the fasteners 70 are receivable in the holes 80 and the fastener sleeve elements 82 in an interference fit.

It is preferred that the fasteners 70 are metal screws. The sleeves 82 prevent contact between the housing and the screw in each case, so that the sheath is electrically isolated from the housing. Alternatively, screws which are made of an electrically insulating material may be used.

In another alternative embodiment (FIG. 6A), the fastener 270 includes the bolt 211, the washer 212, and the nut 213. As described above, the washer 212 preferably is made of an electrically insulating material, e.g., any suitable plastic. However, the bolt and/or the nut may also (or alternatively) be made of an electrically insulating material.

As can be seen in FIG. 6, the apparatus 20 preferably includes screens 84, 86 for covering the inlet and outlet apertures respectively. It is preferable that the screens 84, 86 define openings 88 therein which are sufficiently small to substantially prevent inadvertent contact between the user and the heat generator 30. In particular, it is preferred that the openings 88 be sufficiently small that the apparatus 20 can pass a "probe" test (i.e., a test for determining the extent to which inadvertent contact with the sheathed element is possible).

As shown in FIG. 6, the remaining components of the apparatus 20 are generally fastened together with conventional fastening means. Because the remaining details of the construction of the apparatus 20 are well known in the art, further description of such details is not required herein.

Figure 11:
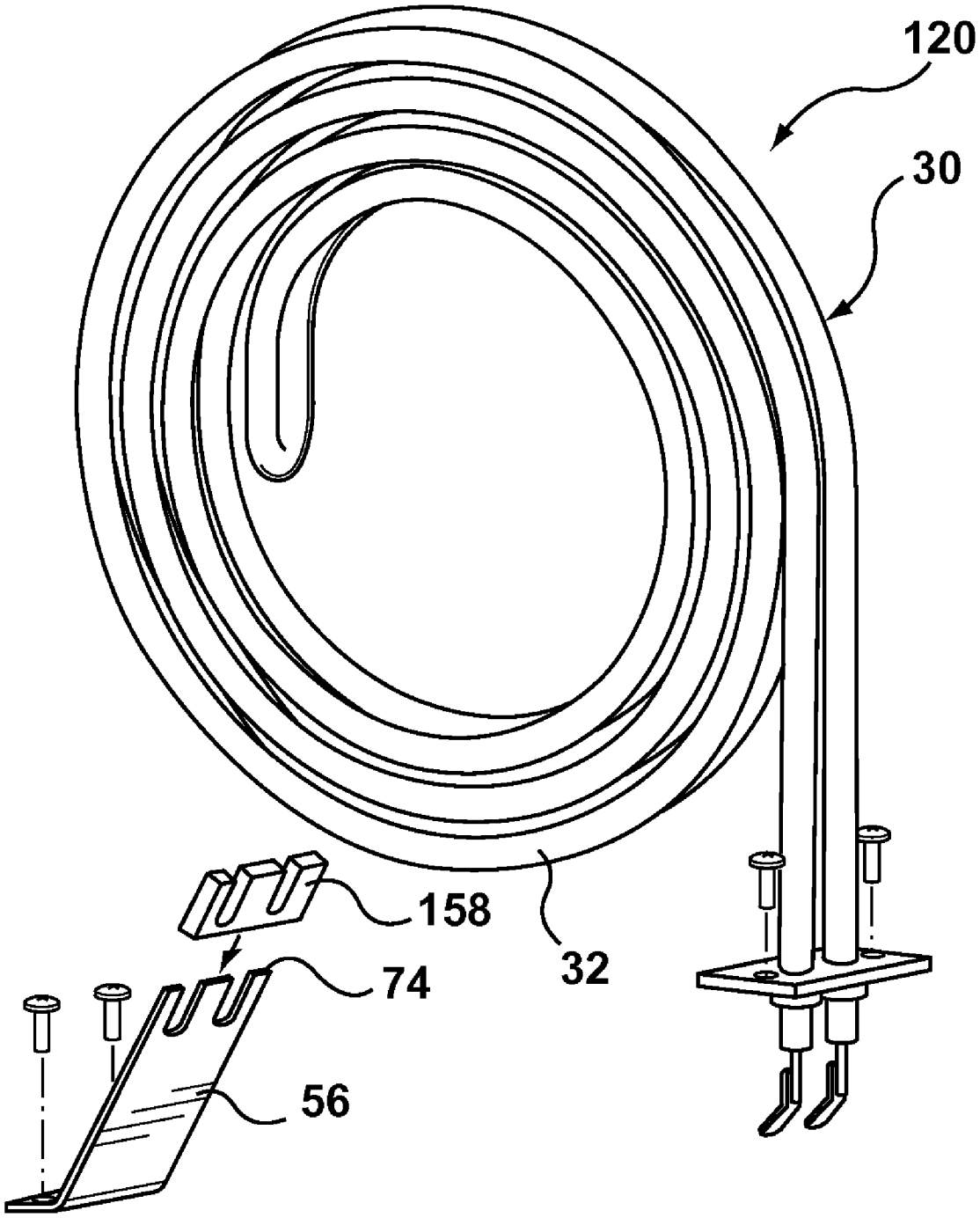
FIG. 11 is an isometric view of an alternative embodiment of the support insulator element.

In an alternative embodiment of the heating apparatus 120, a support insulator element 158 is positioned between the distal end 74 of the support element 56 and the sheath 32 (FIG. 11). In this embodiment, the support insulator element 158 electrically isolates the heat generator 30 from the support element 56. The embodiment disclosed in FIG. 11 is not preferred, however, because such embodiment appears at present to be likely to involve somewhat higher costs to manufacture.

Figure 12:
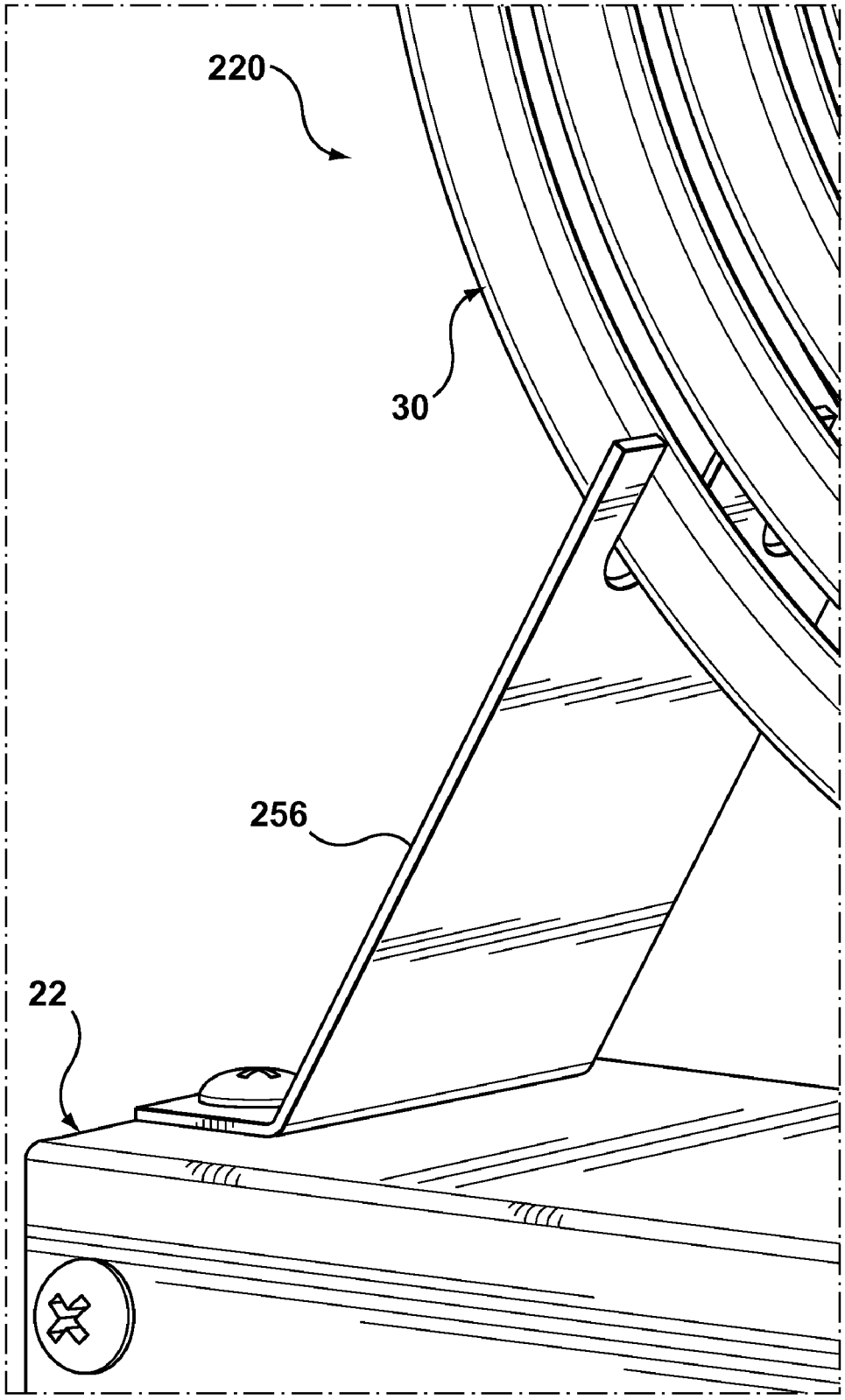
FIG. 12 is an isometric view of another embodiment of the support element.

In another alternative embodiment of the heating apparatus 220, a support element 256 comprises electrical insulation material and locates the heat generator 30 in a predetermined position relative to the inlet and outlet apertures. In this embodiment of the apparatus 220, a separate support insulator element is not included because the support element 256 electrically isolates the sheath relative to the housing 22. The embodiment disclosed in FIG. 12 is not preferred at present because it appears likely to involve somewhat higher costs to manufacture.

Figure 1A:
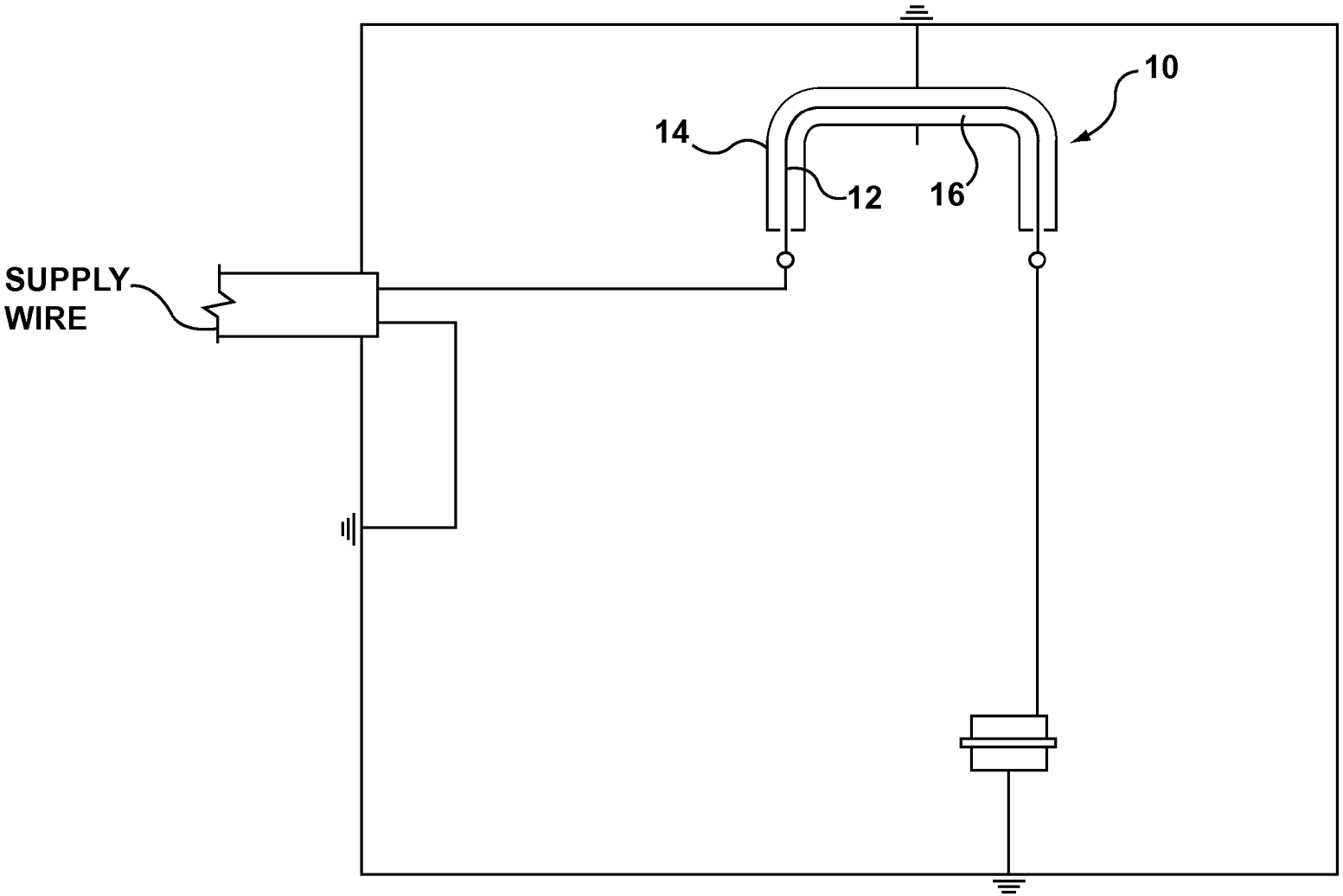
FIG. 1A (Prior Art)
FIG. 1A (previously described) is a circuit diagram for a grounded sheathed element of the prior art.
Figure 1B:
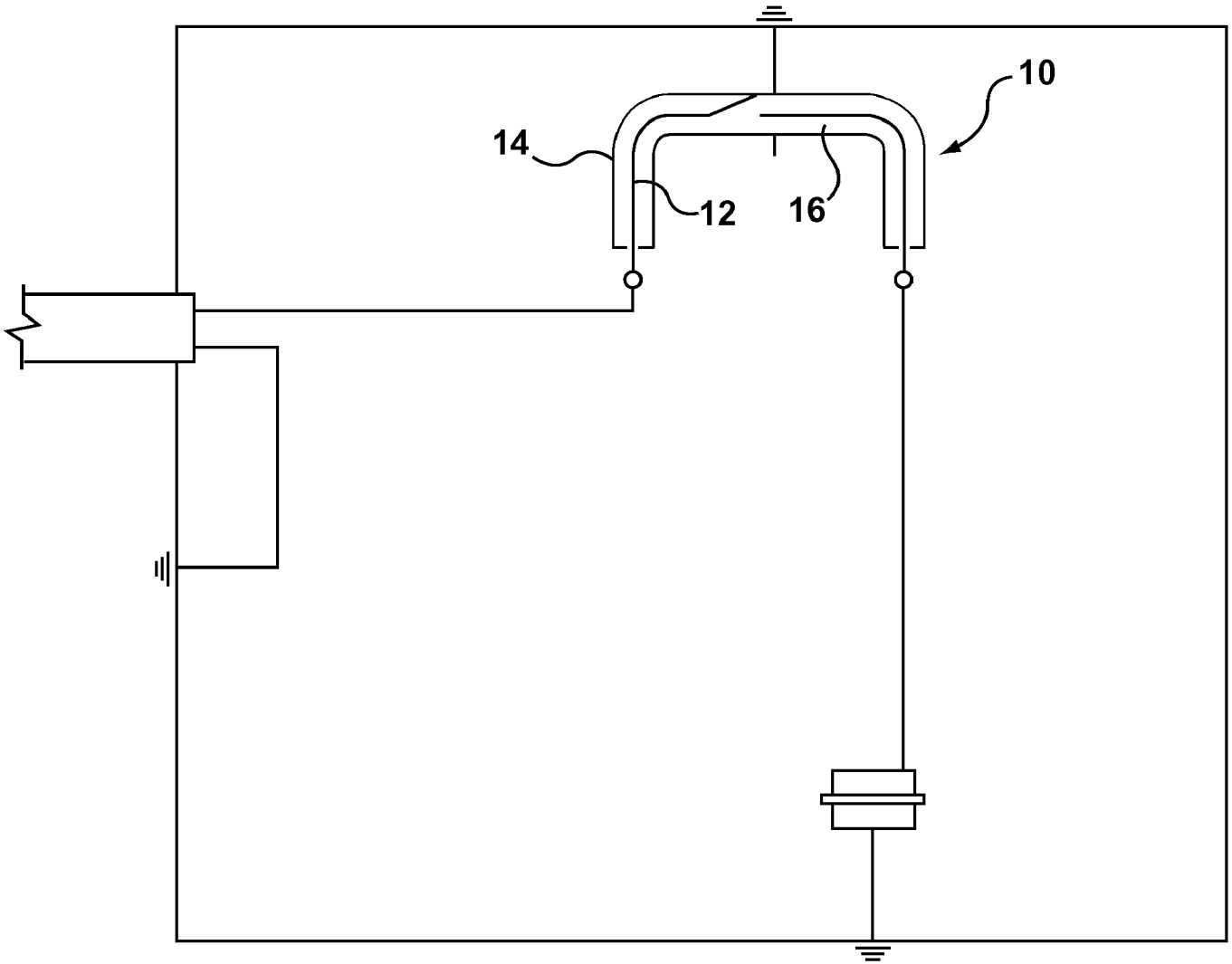
FIG. 1B (Prior Art)
FIG. 1B (previously described) is a circuit diagram for the grounded sheathed element of the prior art, schematically illustrating a ground fault condition.

Testing was conducted to assess the effectiveness of the invention herein. First, an experiment was conducted to determine whether the failure of the sheathed element in the prior art could be replicated in the laboratory. A prior art construction heater was modified to replicate a failure situation as it could occur. This was done by partially cutting the element sheath open with a band saw, up to the resistive wire, but without damaging the resistive wire. Then, a gap between the resistive wire and the sheath was created, and the gap was filled with a solder. Once the heater was powered, catastrophic failure occurred because the wire to sheath contact created the short to ground (i.e., as schematically represented in FIG. 1B).

In order to test the invention herein, a sheathed element (i.e., the heat generator 30) in which the sheath was not grounded was prepared. The sheathed element of the invention herein was cut open, and the gap between the resistive element and the sheath was filled with a solder. Once the heater was powered, however, the result was observed as being very different from that in the previous example (i.e., involving the prior art arrangement), as no signs of catastrophic failure were present. In these circumstances, the sheath became, in effect, a part of the resistive wire, instead of a path to ground.

Any element in a claim that does not explicitly state "means for" performing a specified function, or "step for" performing a specific function, is not to be interpreted as a "means" or "step" clause as specified in 35 U.S.C. §112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

We claim:

1. A heating apparatus comprising:

a housing comprising an inlet aperture and an outlet aperture, the housing defining a volume of air therein;

a heat generator comprising:

an elongate tubular metal sheath extending between an inner end and an outer end;

a resistive wire within the sheath;

a substantially nonconducting material for electrically isolating the sheath relative to the resistive wire;

the heat generator comprising a terminal portion at the inner end and a heating portion extending between the terminal portion and the outer end of the sheath, said terminal portion being adapted for connection to a source of electrical power;

the heating portion of the heat generator being positioned in the housing to heat said volume of air;

at least one insulator for electrically isolating said sheath relative to said housing;

said at least one insulator comprising a body with at least one aperture therein wherein at least a part of said terminal portion is receivable; and the body of said at least one insulator comprising at least one sleeve coaxial with said at least one aperture for electrically isolating said terminal portion from said housing.

2. A heating apparatus according to claim 1 in which said part of said terminal portion is receivable in said at least one sleeve and said at least one aperture in a close-sliding fit.

3. A heating apparatus comprising;

a housing comprising an inlet aperture and an outlet aperture, the housing defining a volume of air therein;

a heat generator comprising:

an elongate tubular metal sheath extending between an inner end and an outer end;

a resistive wire within the sheath;

a substantially nonconducting material for electrically isolating the sheath relative to the resistive wire;

the heat generator comprising a terminal portion at the inner end and a heating portion extending between the terminal portion and the outer end of the sheath, said terminal portion being adapted for connection to a source of electrical power;

the heating portion of the heat generator being positioned in the housing to heat said volume of air;

at least one insulator for electrically isolating said sheath relative to said housing;

a plate attached to said terminal portion and at least one fastener for attaching the plate to said housing;

the body of said at least one insulator comprising at least one hole therein wherein said at least one fastener is at least partially receivable; and the body comprising at least one fastener sleeve element coaxial with said at least one hole, for electrically isolating said at least one fastener from said housing.

4. A heating apparatus according to claim 3 in which said at least one fastener is receivable in said at least one fastener sleeve element and said at least one hole in an interference fit.

5. A heating apparatus according to claim 3 in which said at least one fastener comprises a bolt, a washer, and a nut adapted to cooperate with each other to secure the plate and said at least one insulator to the housing, the bolt being receivable in said at least one fastener sleeve element and said at least one hole.

6. A heating apparatus comprising;

a housing comprising an inlet aperture and an outlet aperture, the housing defining a volume of air therein;

a heat generator comprising:

an elongate tubular metal sheath extending between an inner end and an outer end;

a resistive wire within the sheath;

a substantially nonconducting material for electrically isolating the sheath relative to the resistive wire;

the heat generator comprising a terminal portion at the inner end and a heating portion extending between the terminal portion and the outer end of the sheath, said terminal portion being adapted for connection to a source of electrical power;

the heating portion of the heat generator being positioned in the housing to heat said volume of air;

at least one insulator for electrically isolating said sheath relative to said housing;

at least one support element for locating the heat generator in a predetermined position relative to the inlet and outlet apertures;

at least one support insulator element for electrically isolating said at least one support element relative to said housing;

said at least one support insulator element being positioned between said at least one support element and the housing;

at least one fastener for attaching said at least one support element to said housing;

said at least one support insulator element comprising a body with at least one hole therein wherein said at least one fastener is at least partially receivable; and the body of said at least one support insulator element comprising at least one sleeve element coaxial with said at least one hole, for electrically isolating said at least one fastener from said housing.

7. A heating apparatus according to claim 6 in which said at least one fastener is receivable in said at least one sleeve element and said at least one hole in an interference fit.

8. A heating apparatus according to claim 6 in which at least one fastener comprises a bolt, an insulating washer, and a nut adapted to cooperate with each other to secure said at least one support element and said at least one support insulator element to the housing, the bolt being receivable in said at least one sleeve element and said at least one hole.

* * * * *